United States Patent [19]

Tetherton

[11] Patent Number: 5,056,261

[45] Date of Patent: Oct. 15, 1991

[54] TURNSTILE SYSTEM

[75] Inventor: Cyril F. Tetherton, Poway, Calif.

[73] Assignee: Cubic Automatic Revenue Collection Group, San Diego, Calif.

[21] Appl. No.: 633,062

[22] Filed: Dec. 19, 1990

[51] Int. Cl.[5] ..... E06B 11/08

[52] U.S. Cl. ..... 49/47; 49/35

[58] Field of Search ..... 49/42, 46, 47, 35, 49

[56] References Cited

U.S. PATENT DOCUMENTS

| | | | |
|---|---|---|---|
| Re. 18,211 | 9/1931 | Tulchin | 49/47 |
| 1,841,132 | 1/1932 | Kennedy et al. | 49/47 |
| 2,144,718 | 1/1939 | Gersbach | 49/47 |
| 3,169,329 | 2/1965 | Powers | 49/35 |
| 3,795,075 | 3/1974 | Orzechowski | 49/46 |
| 3,913,717 | 10/1975 | Collins | 49/46 X |
| 4,195,442 | 4/1980 | Keeling et al. | 49/35 |
| 4,525,951 | 7/1985 | Williams | 49/47 |
| 4,640,047 | 2/1987 | Simonin et al. | 49/47 |

FOREIGN PATENT DOCUMENTS

| | | | |
|---|---|---|---|
| 549511 | 12/1957 | Canada | 49/47 |
| 2591371 | 6/1987 | France | 49/46 |
| 1158252 | 7/1969 | United Kingdom | 49/47 |

*Primary Examiner*—Rodney M. Lindsey
*Assistant Examiner*—Jerry Redman
*Attorney, Agent, or Firm*—Gregory O. Garmong

[57] ABSTRACT

A turnstile system used to meter the entry of persons into or out of an area through a passageway includes a first cabinet defining one side of the passageway with a turnstile hub rotationally mounted in the first cabinet. The turnstile hub has an axis of rotation inclined at an angle of from about 38 to about 41 degrees from the vertical, most preferably at about 39 degrees from the vertical. A tripod of three turnstile arms of equal length extends from the hub with the arms lying along the edges of an equilateral pyramid having a pyramid apex that lies along the rotational axis of the hub. A second cabinet defining the other side of the passageway is spaced apart from the first cabinet. The second cabinet has a profile when viewed in the direction parallel to the passageway that includes a lower portion having a first distance from the first cabinet, an upper portion having a second distance from the first cabinet that is greater than the first distance, and a transition portion extending between the first portion and the second portion.

14 Claims, 3 Drawing Sheets

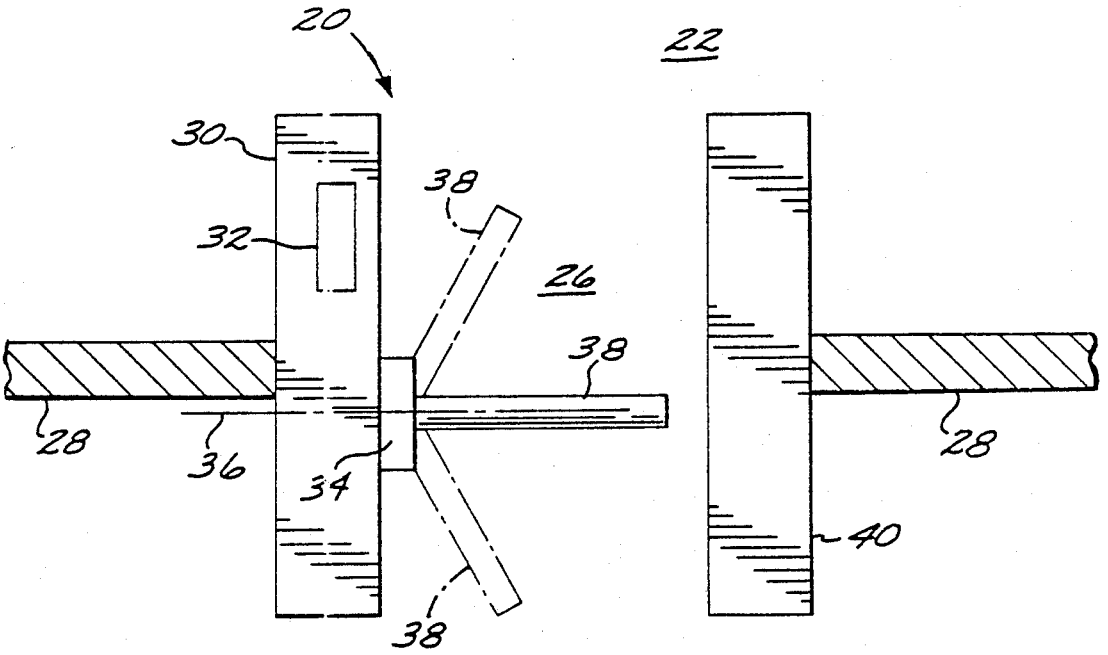
FIG. 1
FIG. 6
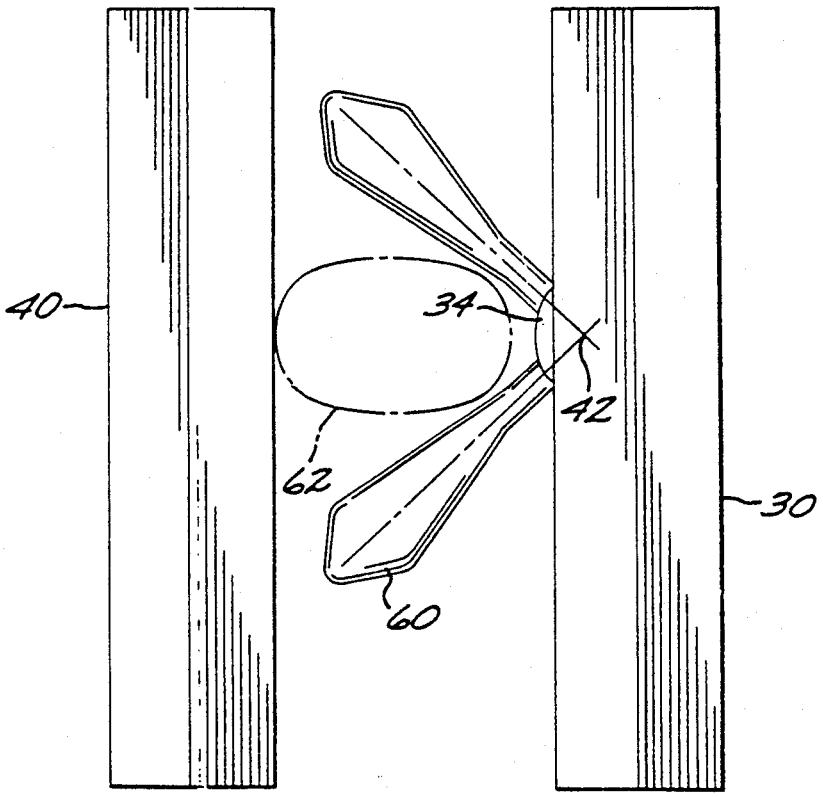

TURNSTILE SYSTEM

BACKGROUND OF THE INVENTION

This invention relates to a turnstile system used to meter and control the passage of persons through a passageway, and, more particularly, to such a turnstile that provides a wide passageway while preventing unauthorized access.

Turnstile systems are placed at the entries and exits of many regulated areas to meter the movement of persons into and out of those areas. Most turnstile systems are used where each person must pay a fee to gain entry, the fee being in the form of cash, tokens, fee cards, or other payment medium. The turnstile remains locked against rotation to permit entry until the fee is paid, and then is unlocked so as to permit one (and only one) person to pass through. In many instances, such turnstile systems are bi-directional, permitting entrance by rotation in one direction after the fee is paid, and permitting exit by rotation in the opposite direction without payment of a fee. Bi-directional turnstile systems are most commonly found in rapid transit stations, although not all rapid transit turnstile systems use bidirectional turnstiles.

The turnstile meters the movement of persons into and out of the regulated area, but also serves as the primary line of defense against persons who seek to defeat the fee payment system and gain entry without payment. Although the number of persons who attempt to defeat the system is typically small, significant revenues may nonetheless be lost. The physical barrier of a turnstile deters most persons who would otherwise try walk to directly into the fee-paid area without paying the fee. However, others may attempt to gain entry by crawling under the turnstile, vaulting over the turnstile, squeezing past the end of the turnstile arm, or crowding two persons through with a single payment. Crawling under the turnstile and squeezing are preferred by some who would attempt to enter without paying, because their activity is less conspicuous than vaulting over the turnstile. The turnstile desirably serves to deter these other types of attempted entry without payment.

The design requirements for a turnstile therefore require a balance between convenience of use for those who pay, and creation of a barrier against entry to those who do not pay. Additionally, since many mass transit systems wish to permit persons to exit through the same turnstile system, such a turnstile must be reversible in its movement to permit persons to pass. There are often fire safety regulations requiring that there be at least a minimum permitted movement rate of persons from the restricted area through the turnstile in the event of an emergency. The turnstile system must be safe for those who pay and even for those who do not pay.

The design considerations involve, at least in part, decisions as to the layout and dimensions of the turnstile system. Convenience of use during entry for persons who pay, the required rate of exit flow in emergencies, and safety usually suggest a larger passageway through the turnstile, while creation of a barrier to unpaid entry suggests reduced passageway size to permit the passageway to be more fully blocked by the turnstile when payment is not made.

There is a continuing need for a turnstile that satisfies these various requirements, is rugged, and can be built and maintained economically. The present invention fulfills this need, and further provides related advantages.

SUMMARY OF THE INVENTION

The present invention provides a turnstile system that provides a wider passageway for entry and exit than previously available in systems having the same degree of protection against persons squeezing past the turnstile arm or crowding two persons through on a single payment. The turnstile also provides an equivalent, or in some cases better, degree of protection than previously available against persons crawling under the turnstile. The turnstile system is dimensioned to avoid injury to users as, for example, occurs in some other systems that can pinch parts of their bodies between the stationary structure and the rotating turnstile arm.

In accordance with the invention, a turnstile system comprises a first cabinet having a passageway side and a floor level; and a turnstile hub rotationally mounted in the first cabinet with an axis of rotation of the hub inclined at an angle of from about 38 to about 41 degrees from the vertical toward the passageway side, the turnstile hub having a tripod of three turnstile arms of equal length extending therefrom with the arms lying along the edges of an equilateral pyramid having a pyramid apex that lies along the rotational axis of the hub. Preferably, the angle of inclination is about 39 degrees.

In a preferred approach, there is provided a a second cabinet spaced apart from the first cabinet, the space between the passageway side of the first cabinet and the second cabinet defining a passageway. The second cabinet has a profile when viewed in the direction parallel to the passageway that includes a lower portion having a first distance from the first cabinet, an upper portion having a second distance from the first cabinet that is greater than the first distance, and a transition portion extending between the first portion and the second portion, with the transition portion being disposed at a height less than that of the apex of the pyramid.

Although the basic design principles are generally applicable, absolute dimensions are important and critical to the selection of the most preferred embodiments of the invention, for two reasons. First, the turnstile is designed with reference to the human body. Body sizes are roughly the same from person to person, but the body dimensions do vary from person to person. Standard sizing aids are available to quantify the normal range of body sizes. Additionally, because most turnstile systems are procured by governmental agencies, their preselected standard design limitations must be met in a preferred turnstile design. For example, it is a common requirement that the clearance between the turnstile arm and stationary structure be some preselected amount, typically about 1.5 inches, during rotation so that persons cannot be pinched by the mechanism. On the other hand, the same governmental organization may often specify that the clearance cannot be greater than 3 inches, to prevent persons from squeezing around the end of the turnstile arm.

In a most preferred embodiment, the axis of rotation of the hub is at about 39 degrees to the vertical, and the turnstile hub is positioned with the pyramid apex about 2.0 inches horizontally from the passageway side of the first cabinet and about 33 inches vertically above the floor of the first cabinet. This design results in a minimum passageway width of about 18.0 inches which meeting a minimum clearance requirement of 1.5 inches and a maximum clearance limitation of 3 inches. The passageway width of about 18.0 inches is significant, because it permits comfortable passage by the 95th percentile person defined in the standards.

In a somewhat less preferred embodiment, the angle of the hub axis to the vertical is about 40 degrees, and the hub is positioned with the pyramid apex about 3.5 inches horizontally from the passageway side of the first cabinet and about 33 inches vertically above the floor of the first cabinet. This design results in a minimum passageway width of about 15 inches, while again meeting the clearance requirements. The 95th percentile person can pass through this passageway, but it is slightly cramped. Various intermediate combinations of dimensions can be achieved by adjusting these parameters within the scope of the invention.

The approach of the invention achieves a good balance of accessibility for persons who pay and deterrence for those who do not. Any acceptable types of fee receiving station and rotational mechanism for the turnstile can be used with the present design. Other features and advantages of the invention will be apparent from the following detailed description of the preferred embodiments, taken in conjunction with the accompanying drawings, which illustrate, by way of example, the principles of the invention.

BRIEF DESCRIPTION OF THE DRAWINGS

FIG. 1 is a plan view of a turnstile system;

FIG. 6 is a plan view of a turnstile system using a diamond-shaped turnstile barrier arm.

DETAILED DESCRIPTION OF THE PREFERRED EMBODIMENTS

Figure 2:
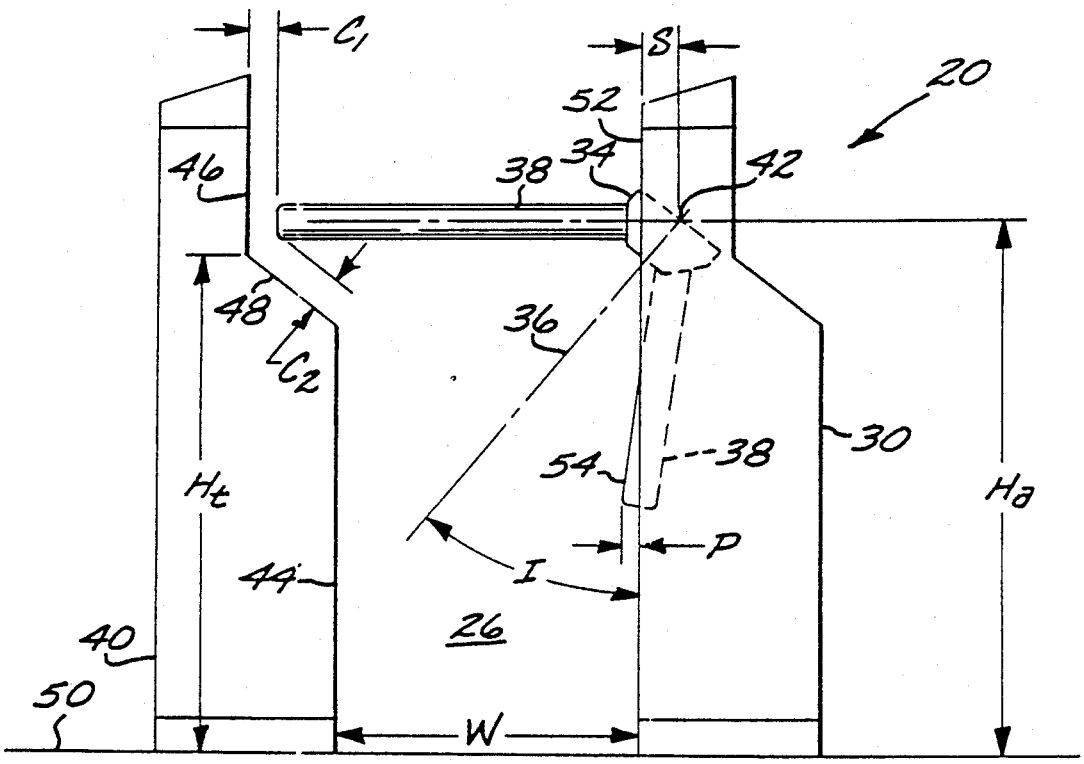
FIG. 2 is an elevational view, from the entry area, of a preferred turnstile system, with a hidden portion of the turnstile mechanism shown in phantom view.

FIG. 1 presents a general plan view of a turnstile system 20 for metering admission from an entry area 22 to a fee-paid area 24 through a passageway 26. Such a turnstile system might commonly be found in subway stations or other types of mass transit facilities. FIG. 1 shows a single system 20, but multiple turnstile systems are often placed in a side-by-side fashion to increase the total number of persons that may be accommodated and to provide redundancy in the event of machinery failures. Impassable walls 28 are usually erected on either side of the turnstile system 20 so that persons desiring to enter the fee-paid area, either with or without payment of the required fee, must pass through the turnstile system 20.

The turnstile system 20 typically includes a first cabinet 30 having a fee-receiving station 32 mounted in a place that is convenient for the person who wishes to use the system 20. The fee-receiving station 32 may be structured to receive coins, currency, tokens, or fee cards. The fee-receiving station 32 then determines whether payment has been properly made and, if so, permits access to the fee-paid area through the passageway 26.

A turnstile hub 34 is rotationally mounted to the first cabinet 30, with a rotational axis 36. A number, typically three, of turnstile barrier arms 38 project from the rotational hub 34. The turnstile arms 38 may be cylinders, but also may have other shapes, such as a diamond shape that will be discussed subsequently. Turnstile mechanisms are known in the art, see for example, U.S. Pat. Nos. 3,913,717; 3,998,008; and 4,020,927, whose disclosures are incorporated by reference. The turnstile hub 34 is normally locked into a position as shown, with one of the turnstile arms 38 horizontal and extending across the passageway 26. When proper payment is made into the fee-receiving station 32, the hub is unlocked and permitted to rotate 120 degrees (for the three-arm case) to permit one person to pass through the passageway 26.

A second cabinet 40 is disposed opposite to, and spaced apart from, the first cabinet 30. The space between the cabinets 30 and 40 is the passageway 26. An important consideration for patron convenience is the width of the passageway 26, at ground level.

Figure 3:
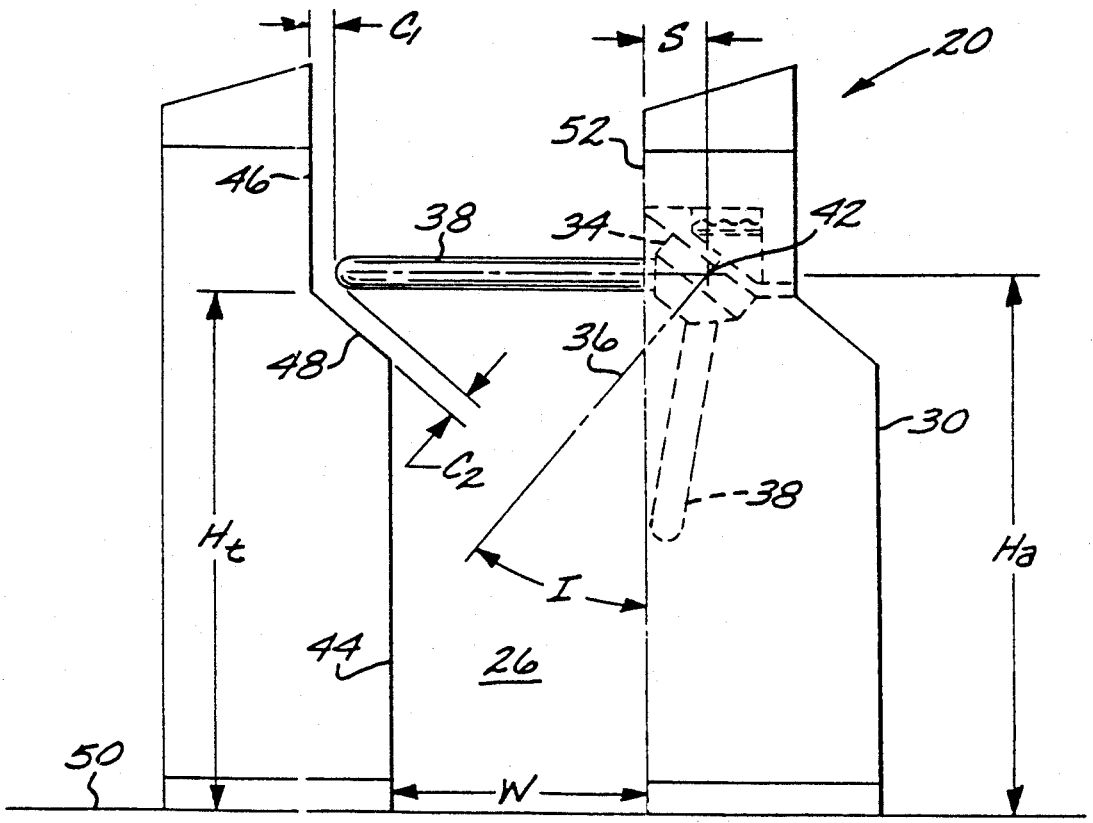
FIG. 3 is an elevational view, from the entry area, of a less-preferred turnstile system, with a hidden portion of the turnstile mechanism shown in phantom view.

FIGS. 2 and 3 present elevational views of two turnstile systems in accordance with the invention from the point of view of the entry area 22. The structure of FIG. 2 is the presently most preferred embodiment, and that of FIG. 3 is a second, slightly less preferred, embodiment of the invention.

In both illustrated embodiments, exactly three turnstile arms 38 of equal length are mounted to the hub 34 in a tripod arrangement. The arms 38 are arranged geometrically to lie along the sides of an equilateral pyramid having an apex 42. The apex 42 lies on the axis of rotation 36 of the hub 34. The arms 38 typically do not extend to the apex 42, but instead the apex 42 lies on the extensions of the arms 38. It will be appreciated that the apex 42 is not a specific piece of structure, but instead is a point in space lying at the intersection of the axes of the arms 38, which will be used to define elements of structure of the turnstile system 20.

The axis of rotation 36 is inclined relative to a vertical line, in the direction toward the passageway 26, by an angle I of from about 38 to about 41 degrees. It has been discovered that selection of the angle of inclination I within this range permits joint optimization of a passageway width W and the deterrence by the turnstile to attempts to crawl under it, while avoiding the possibility of pinching the person using the turnstile system between moving and stationary parts of the mechanism. If the angle I is outside of this range, the optimization cannot be achieved. In the preferred embodiment of FIG. 2, the angle of inclination I is 39 degrees, while in the embodiment of FIG. 3 the angle of inclination I is 40 degrees.

The present selection of the angle of inclination I is to be contrasted with that of prior turnstile systems. In some prior types of turnstile systems, the axis of rotation of the hub is vertical. In most currently produced types of turnstile systems, the axis of rotation of the hub is inclined to the vertical at an angle of 45 degrees, see for example, U.S. Pat. No. 3,913,717, at col. 2, lines 49–52. According to the present invention, the turnstile system can be optimized to a higher degree if the angle of inclination I is selected to be from about 38 to about 41 degrees.

Optimization of the turnstile system 20 is aided by the selection of the location of the apex 42 and by the shape of the second cabinet 40. The second cabinet 40 is formed with the face adjacent the passageway 26 in at least three segments. A lower portion 44 is vertical and spaced apart from the first cabinet 30 by the distance that is defined as the passageway width W. An upper portion 46 is vertical and spaced apart from the first cabinet 30 by a distance that is greater than the passageway width W. A transition portion 48 extends from the first portion 44 to the second portion 46. The transition portion 48 is at a height $H_t$ (the highest part of the transition portion 48) from a floor 50 upon which the turnstile system 20 rests that is less than the height $H_a$ of the apex 42 from the floor 50. ($H_a$ is typically about 33 inches.) In the preferred approaches of FIGS. 2 and 3, the transition portion 48 is angled outwardly relative to the first portion 44 by an angle that is approximately (though not necessarily exactly) equal to the angle I.

The length of the arms 38 is sufficient to reach to within a distance $C_1$ from the upper portion 48. $H_t$ is preferably chosen such that a clearance $C_2$ is maintained between the inclined portion 48 and the arm 38 as the arm 38 is rotated on the hub 34 about the axis of rotation 36. $C_1$ and $C_2$ are clearance that are typically specified by a customer of the turnstile system 20, and both typically are on the order of 1.5 inches. The positioning of the hub 34 and the length of the arms 38 must also satisfy other clearance criteria, and in particular a maximum clearance between the end of the arm and the second cabinet 40 when the hub 34 has been rotated 60 degrees from the position shown in FIGS. 1–3. The maximum clearance at 60 degrees is selected to prevent persons from squeezing past the arm 38 at this degree of rotation, is usually selected by a customer of the turnstile system, and is typically on the order of about 3.0 inches.

The turnstile hub 34 is mounted such that the apex 42 is spaced back from a face 52 of the first cabinet 30 adjacent the passageway 26 by a distance S. For the preferred embodiment of FIG. 2, S is 2.0 inches, $H_a$ is 33 inches, and W is 18.0 inches. For the embodiment of FIG. 3, S is 3.5 inches, $H_a$ is 33 inches, and W is 15.0 inches. In each case, the turnstile system 20 is designed so that adjacent systems have a center-to-center spacing of 28 inches.

Figure 5:
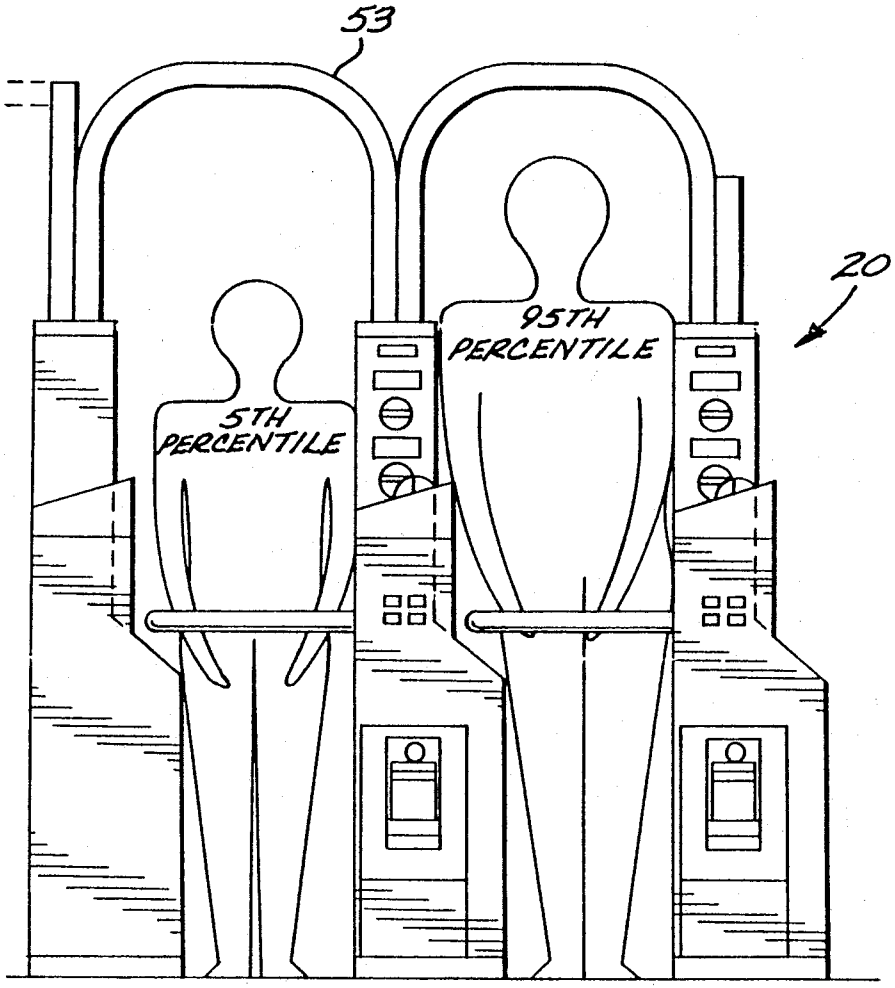
FIG. 5 is an elevational view, from the fee-paid area, of the less-preferred turnstile system of FIG. 3 with standardized person dimensions superimposed.
Figure 4:
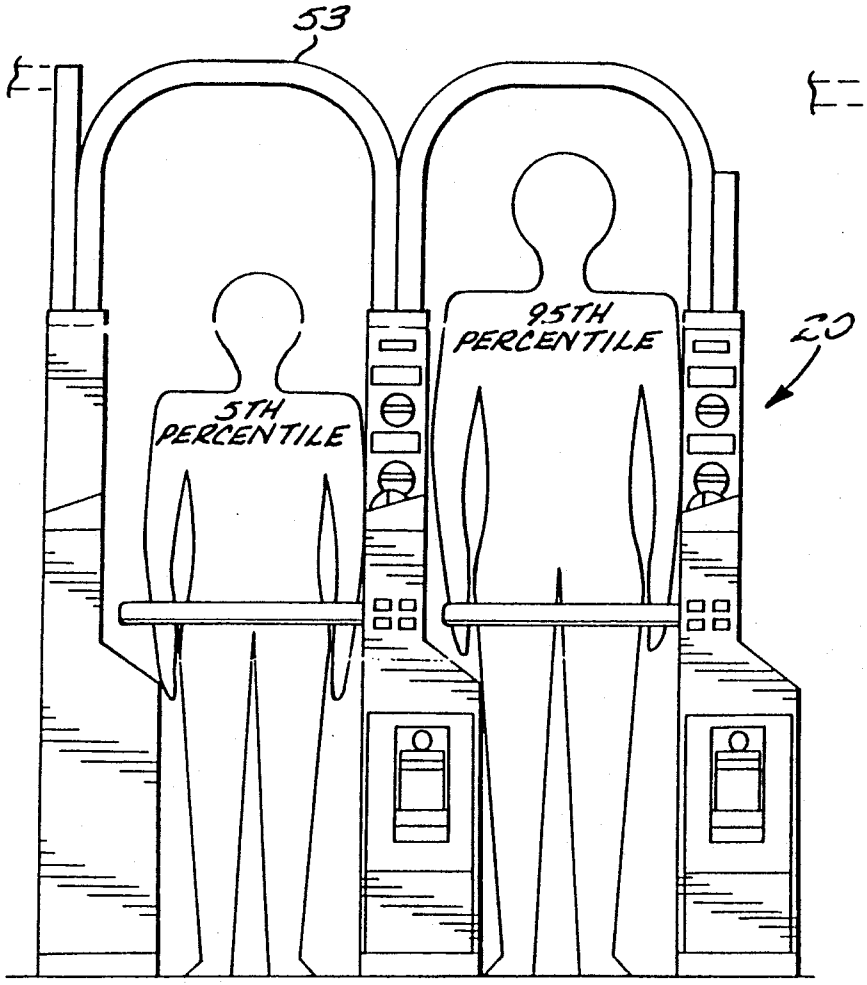
FIG. 4 is an elevational view, from the fee-paid area, of the preferred turnstile system of FIG. 2 with standardized person dimensions superimposed.

The passageway width W is an important consideration in the design of a turnstile system. The width W determines not only the comfort of a person who is entering the fee-paid area through the turnstile, but also the ability to permit persons to leave the fee-paid area rapidly, as during a fire emergency. FIGS. 4 and 5 illustrate variations of the turnstile systems of FIGS. 2 and 3, respectively, each having an overhead cable system 53. In each case, two of the turnstile systems 20 are shown side-by-side. For one of the systems of each pair, a "5th percentile" person is indicated, and for the other, a "95th percentile" person is indicated in the passageway. These percentile sizings are standardized design aids available from MIL-STD-1472A. The "5th percentile" person is one who, statistically, is larger than 5 percent of the U.S. population, while a "95th percentile" person is one who, statistically, is larger than 95 percent of the U.S. population. Systems for use by a major fraction of the population can be designed to these standard values.

As shown in FIG. 4, the preferred embodiment of the invention, with an 18.0 inch passageway width W, permits comfortable passage of both the 5th percentile person and the 95th percentile person. As shown in FIG. 5, the less preferred embodiment permits reasonably comfortable passage of the 5th percentile person but is marginal for the 95th percentile person.

Since both designs of FIGS. 2 and 3 meet specified clearances $C_1$ and $C_2$ of 1.5 degrees and a 60 degree maximum clearance of 3 inches, the approach of FIG. 2 is preferred. However, from FIG. 2 it will be seen that there is a slight protrusion of one of the turnstile arms, shown at numeral 54 and having a magnitude P, into the passageway area. In this preferred embodiment, with the dimensions stated previously, the protrusion P is about 1.2 inches, and the protrusion occurs at about knee level for both the 5th percentile and 95th percentile persons. Because the protrusion is at such a low level, it is judged by the inventor as acceptable in light of the much larger width W of the passageway of the embodiment of FIG. 2 as compared with the embodiment of FIG. 3. However, other persons may reach the opposite conclusion, and choose the embodiment of FIG. 3 to be preferred, even though the passageway width is less, because there is no protrusion.

A range of designs extending from that of FIG. 2 to that of FIG. 3 can be selected. The key to all of these designs is to select the angle of inclination I of the rotational axis 36 of the hub 34 to be from about 38 to about 41 degrees, rather than the traditional 45 degrees.

FIG. 6 illustrates another modification that can increase the singulation function of the turnstile system. Alternatively stated, passage of two persons with one payment is made more difficult by the design of FIG. 6. In FIG. 6, a diamond-shaped barrier arm 60 is utilized instead of a tubular or cylindrical barrier arm. The area occupied by a person 62 is indicated in FIG. 6. The area available within the limits of the barrier arms 60 is just large enough for that one person to pass, and it would be difficult for two people to pass with the payment of only one fee. The diamond-shaped barrier arms of FIG. 6 can be used in conjunction with any of the previously discussed arrangements of the turnstile hub.

The approach of the present invention thus provides an optimized turnstile system geometrical design compatible with any selected internal mechanisms that fit within the indicated cabinet profiles, such as the bearing and gearing mechanism of the hub 34 and the fee receiving station 32. The details of these mechanisms do not come within the scope of the invention.

Although particular embodiments of the invention have been described in detail for purposes of illustration, various modifications may be made without departing from the spirit and scope of the invention. Accordingly, the invention is not to be limited except as by the appended claims.

What is claimed is:

1. A turnstile system, comprising:

a first cabinet having a passageway side and a floor level; and a turnstile hub rotationally mounted in the first cabinet with an axis of rotation of the hub inclined at an angle of from about 38 to about 41 degrees from the vertical toward the passageway side, the turnstile hub having a tripod of three turnstile arms of equal length extending therefrom with the arms lying along the edges of an equilateral pyramid having a pyramid apex that lies along the rotational axis of the hub.

2. The turnstile system of claim 1, further including a second cabinet spaced apart from the first cabinet, the space between the passageway side of the first cabinet and the second cabinet defining a passageway, the second cabinet having a profile when viewed in the direction parallel to the passageway that includes a lower portion having a first distance from the first cabinet, an upper portion having a second distance from the first cabinet that is greater than the first distance, and a transition portion extending between the first portion and the second portion, the transition portion being disposed at a height less than that of the apex of the pyramid.

3. The turnstile system of claim 1, wherein the angle of the hub axis to the vertical is about 39 degrees.

4. The turnstile system of claim 3, wherein the hub is positioned with the pyramid apex about 2.0 inches horizontally from the passageway side of the first cabinet and about 33 inches vertically above the floor of the first cabinet.

5. The turnstile system of claim 1, wherein the angle of the hub axis to the vertical is about 40 degrees.

6. The turnstile system of claim 4, wherein the hub is positioned with the pyramid apex about 3.5 inches horizontally from the passageway side of the first cabinet and about 33 inches vertically above the floor of the first cabinet.

7. A turnstile system, comprising:

a first cabinet having a passageway side and a floor level;

a turnstile hub rotationally mounted in the first cabinet with an axis of rotation of the hub inclined at an angle of from about 38 to about 41 degrees from the vertical toward the passageway side, the turnstile hub having a tripod of three turnstile arms of equal length extending therefrom with the arms lying along the edges of an equilateral pyramid having a pyramid apex that lies along the axis of rotation of the hub;

a second cabinet spaced apart from the first cabinet, the space between the passageway side of the first cabinet and the second cabinet defining a passageway, the second cabinet having a profile when viewed in the direction parallel to the passageway that includes a lower portion having a first distance from the first cabinet, an upper portion having a second distance from the first cabinet that is greater than the first distance, and a transition portion extending between the first portion and the second portion, the transition portion being disposed at a height less than that of the apex of the pyramid, the second cabinet being spaced apart from the first cabinet by a distance such that a tip of one of the turnstile arms disposed in a horizontal plane is at least a preselected minimum distance from the upper portion of the second cabinet.

8. The turnstile system of claim 7, wherein the transition portion of the second cabinet angles outwardly from the passageway at an angle to the vertical of about 90 degrees minus the angle of the hub axis to the vertical.

9. The turnstile system of claim 7, wherein the angle of the hub axis to the vertical is about 39 degrees.

10. The turnstile system of claim 9, wherein the hub is positioned with the pyramid apex about 2.0 inches horizontally from the passageway side of the first cabinet and about 33 inches vertically above the floor of the first cabinet, and the spacing between the first cabinet and the lower portion of the second cabinet is about 18.0 inches.

11. The turnstile system of claim 7, wherein the angle of the hub axis to the vertical is about 40 degrees.

12. The turnstile system of claim 11, wherein the hub is positioned with the pyramid apex about 3.5 inches horizontally from the passageway side of the first cabinet and about 33 inches vertically above the floor of the first cabinet, and the spacing between the first cabinet and the lower portion of the second cabinet is about 15.0 inches.

13. The turnstile system of claim 7, wherein the turnstile arms are cylindrical tubes.

14. The turnstile system of claim 7, wherein the preselected minimum distance is about 1.5 inches.

* * * * *